US006895757B2

(12) United States Patent
Mitchell et al.

(10) Patent No.: US 6,895,757 B2
(45) Date of Patent: May 24, 2005

(54) SEALING ASSEMBLY FOR THE AFT END OF A CERAMIC MATRIX COMPOSITE LINER IN A GAS TURBINE ENGINE COMBUSTOR

(75) Inventors: Krista Anne Mitchell, Springboro, OH (US); David Edward Bulman, Cincinnati, OH (US); Mark Eugene Noe, Morrow, OH (US); Harold Ray Hansel, Mason, OH (US); Christopher Charles Glynn, Hamilton, OH (US); John David Bibler, Tucson, AZ (US)

(73) Assignee: General Electric Company, Schenectady, NY (US)

( * ) Notice: Subject to any disclaimer, the term of this patent is extended or adjusted under 35 U.S.C. 154(b) by 264 days.

(21) Appl. No.: 10/361,456

(22) Filed: Feb. 10, 2003

(65) Prior Publication Data

US 2004/0154303 A1 Aug. 12, 2004

(51) Int. Cl.[7] ..... F02C 7/20
(52) U.S. Cl. ..... 60/772; 60/753; 60/800
(58) Field of Search ..... 60/753, 799, 800, 60/772; 415/134, 135, 136, 138

(56) References Cited

U.S. PATENT DOCUMENTS

| | | | | |
|---|---|---|---|---|
| 5,289,677 | A | 3/1994 | Jarrell | 60/39.31 |
| 5,333,443 | A | 8/1994 | Halila | 60/39.31 |
| 5,337,583 | A | 8/1994 | Giles et al. | 60/752 |
| 6,065,756 | A | 5/2000 | Eignor et al. | 277/545 |
| 6,199,871 | B1 | 3/2001 | Lampes | 277/614 |
| 6,418,727 | B1 | 7/2002 | Rice et al. | 60/799 |
| 6,453,675 | B1 | 9/2002 | Royle | 60/800 |
| 6,547,257 | B2 * | 4/2003 | Cromer | 277/630 |
| 2002/0108378 | A1 | 8/2002 | Ariyoshi et al. | |

OTHER PUBLICATIONS

"ESPR Combustor Concept," Kawasaki Heavy Industries, Ltd. (Mar. 2000), Cover sheet and figure (partially screened).

Hiroyuki Ninomiya et al., "Development of Low NOx LPP Combustor," The First International Symposium of Environmentally Compatible Propulsion System for Next–Generation Supersonic Transport, Tokyo, Japan (May 21–22, 2002), p. 1–6.

* cited by examiner

*Primary Examiner*—Ehud Gartenberg
(74) *Attorney, Agent, or Firm*—William Scott Andes; James P. Davidson

(57) ABSTRACT

An assembly for providing a seal at an aft end of a combustor liner for a gas turbine engine including a longitudinal centerline axis extending therethrough. The sealing assembly includes a substantially annular first sealing member positioned between an aft portion of a support member and the liner aft end so as to seat on a designated surface portion of the liner aft end and a substantially annular second sealing member positioned between the support member aft portion and a turbine nozzle located downstream of the liner aft end so as to seat on a designated surface portion of the support member aft portion. Accordingly, the first sealing member is maintained in its seated position as the support member aft portion moves radially with respect to the liner aft end and the second sealing member is maintained in its seated position as the support member aft portion moves axially with respect to the turbine nozzle. The first and second sealing members are also maintained in their respective seating positions as the support member aft portion moves axially with respect to the liner aft end and radially with respect to the turbine nozzle.

23 Claims, 6 Drawing Sheets

SEALING ASSEMBLY FOR THE AFT END OF A CERAMIC MATRIX COMPOSITE LINER IN A GAS TURBINE ENGINE COMBUSTOR

STATEMENT REGARDING FEDERALLY SPONSORED RESEARCH AND DEVELOPMENT

The U.S. Government may have certain rights in this invention pursuant to contract number NAS3-27720.

BACKGROUND OF THE INVENTION

The present invention relates generally to the use of Ceramic Matrix Composite liners in a gas turbine engine combustor and, in particular, to the sealing of such CMC liners with a support member for the combustor at an aft end in a manner that accommodates differences in radial and axial growth therebetween.

It will be appreciated that the use of non-traditional high temperature materials, such as Ceramic Matrix Composites (CMC), are being studied and utilized as structural components in gas turbine engines. There is particular interest, for example, in making combustor components which are exposed to extreme temperatures from such material in order to improve the operational capability and durability of the engine. As explained in U.S. Pat. No. 6,397,603 to Edmondson et al., substitution of materials having higher temperature capabilities than metals has been difficult in light of the widely disparate coefficients of thermal expansion when different materials are used in adjacent components of the combustor. This can result in a shortening of the life cycle of the components due to thermally induced stresses, particularly when there are rapid temperature fluctuations which can also result in thermal shock.

Accordingly, various schemes have been employed to address problems that are associated with mating parts having differing thermal expansion properties. As seen in U.S. Pat. No. 5,291,732 to Halila, U.S. Pat. No. 5,291,733 to Halila, and U.S. Pat. No. 5,285,632 to Halila, an arrangement is disclosed which permits a metal heat shield to be mounted to a liner made of CMC so that radial expansion therebetween is accommodated. This involves positioning a plurality of circumferentially spaced mount pins through openings in the heat shield and liner so that the liner is able to move relative to the heat shield.

U.S. Pat. No. 6,397,603 to Edmondson et al. also discloses a combustor having a liner made of Ceramic Matrix Composite materials, where the liner is mated with an intermediate liner dome support member in order to accommodate differential thermal expansion without undue stress on the liner. The Edmondson et al. patent further includes the ability to regulate part of the cooling air flow through the interface joint.

Another concern with the implementation of CMC liners is providing a seal with other metal hardware. Besides taking into account the differences in thermal growth, the CMC material is very abrasive since a part made from such material includes multiple layers of fabric and essentially has a woven appearance. Accordingly, this makes it difficult to produce a long lasting seal due to the wear thereon. It will also be understood that the support pieces of prior combustors have generally been welded to the metal liners, but this approach is not available since CMC cannot be welded to metal.

It will be appreciated that the sealing of air between an aft end of the combustor liner and a turbine nozzle located downstream thereof is also desired. While sealing in this area has occurred previously with metal liners, it has heretofore been accomplished in conjunction with a hard connection, such as through welding, between the liner and an adjacent support member. According to the CMC construction of the liners in the present combustor, however, such sealing must occur in an environment where there is only a seal between the liner and adjacent support member.

It will be noted that a mounting assembly has been disclosed in a patent application entitled "Mounting Assembly For The Aft End Of A Ceramic Matrix Composite Liner In A Gas Turbine Engine Combustor," having Ser. No. 10/326,209, and owned by the assignee of the present invention. Such mounting assembly takes into account the differences in thermal growth created by the respective coefficients of thermal expansion of the liners made of ceramic matrix composite and the support members made of metal. The mounting assembly therein, however, involves a sliding connection between the liner and support member which may cause axial loads to be incurred. Further, the liner is typically required to incorporate additional thickness at its aft end to accommodate the aforementioned pin configuration.

Accordingly, it would be desirable for a sealing assembly to be developed for use with a combustor having a CMC liner, where such sealing assembly is able to accommodate differences in radial and/or axial growth between such liner and an adjacent support member of the combustor while maintaining a seal to prevent air from entering the combustor flow path. It is also desirable for the sealing assembly to avoid hard connections between the support member.

BRIEF SUMMARY OF THE INVENTION

In a first exemplary embodiment of the invention, an assembly is disclosed for providing a seal at an aft end of a combustor liner for a gas turbine engine including a longitudinal centerline axis extending therethrough. The sealing assembly includes a substantially annular first sealing member positioned between an aft portion of a support member and the liner aft end so as to seat on a designated surface portion of the liner aft end and a substantially annular second sealing member positioned between the support member aft portion and a turbine nozzle located downstream of the liner aft end so as to seat on a designated surface portion of the support member aft portion. Accordingly, the first sealing member is maintained in its seated position as the support member aft portion moves radially with respect to the liner aft end and the second sealing member is maintained in its seated position as the support member aft portion moves axially with respect to the turbine nozzle. The first and second sealing members are also maintained in their respective seating positions as the support member aft portion moves axially with respect to the liner aft end and radially with respect to the turbine nozzle.

In a second exemplary embodiment of the invention, a combustor for a gas turbine engine having a longitudinal centerline axis extending therethrough is disclosed as including: an inner liner having a forward end and an aft end, the inner liner being made of a ceramic matrix composite material; an annular inner support member located adjacent to the inner liner aft end, the inner support member being made of a metal; and, an assembly for providing a first seal between the inner liner aft end and an aft portion of the inner support member and a second seal between the inner support member aft portion and a turbine nozzle located downstream of the inner liner aft end. Accordingly, the first seal is maintained between the inner support member aft portion and the inner liner aft end when the inner support member moves with respect to the inner liner aft end in a radial direction and the second seal is maintained between the inner support member aft portion and the turbine nozzle when the inner support member moves with respect to the turbine nozzle in an axial direction. The first and second seals are also maintained when the inner support member moves with respect to the inner liner aft end in an axial direction and with respect to the turbine nozzle in a radial direction.

In accordance with a third embodiment of the invention, a combustor for a gas turbine engine having a longitudinal centerline axis extending therethrough is disclosed as including: an outer liner having a forward end and an aft end, the outer liner being made of a ceramic matrix composite material; an annular outer support member located adjacent to the outer liner, the outer support member being made of a metal; and, an assembly for providing a first seal between the outer liner aft end and an aft portion of the outer support member and a second seal between the outer support member aft portion and a turbine nozzle located downstream of the outer liner aft end. Accordingly, the first seal is maintained between the outer support member aft portion and the outer liner aft end when the outer support member moves with respect to the outer liner aft end in a radial direction and the second seal is maintained between the outer support member aft portion and the turbine nozzle when the outer support member moves with respect to the turbine nozzle in an axial direction. The first and second seats are also maintained when the outer support member moves with respect to the outer liner aft end in an axial direction and with respect to the turbine nozzle in a radial direction.

In accordance with a fourth embodiment of the invention, a method of providing a first seal between an aft end of a liner and an aft portion of an annular support member of a gas turbine engine combustor and a second seal between the support member aft portion and a turbine nozzle located downstream of the liner aft end is disclosed, wherein the liner is made of a material having a lower coefficient of thermal expansion than the support member. The method includes the steps of maintaining a first sealing member in a seated position between the support member aft portion and a designated surface portion of the liner aft end in a manner so as to permit radial movement of the support member aft portion with respect to the liner aft end and maintaining a second sealing member in a seated position between a designated surface portion of the support member aft portion and the turbine nozzle in a manner so as to permit axial movement of the support member aft portion with respect to the turbine nozzle. Further, the method may include the steps of maintaining the first and second sealing members in their respective seated positions during axial movement of the support member aft portion with respect to the liner aft end and radial movement of the support member aft portion with respect to the turbine nozzle.

DETAILED DESCRIPTION OF THE INVENTION

Figure 1:
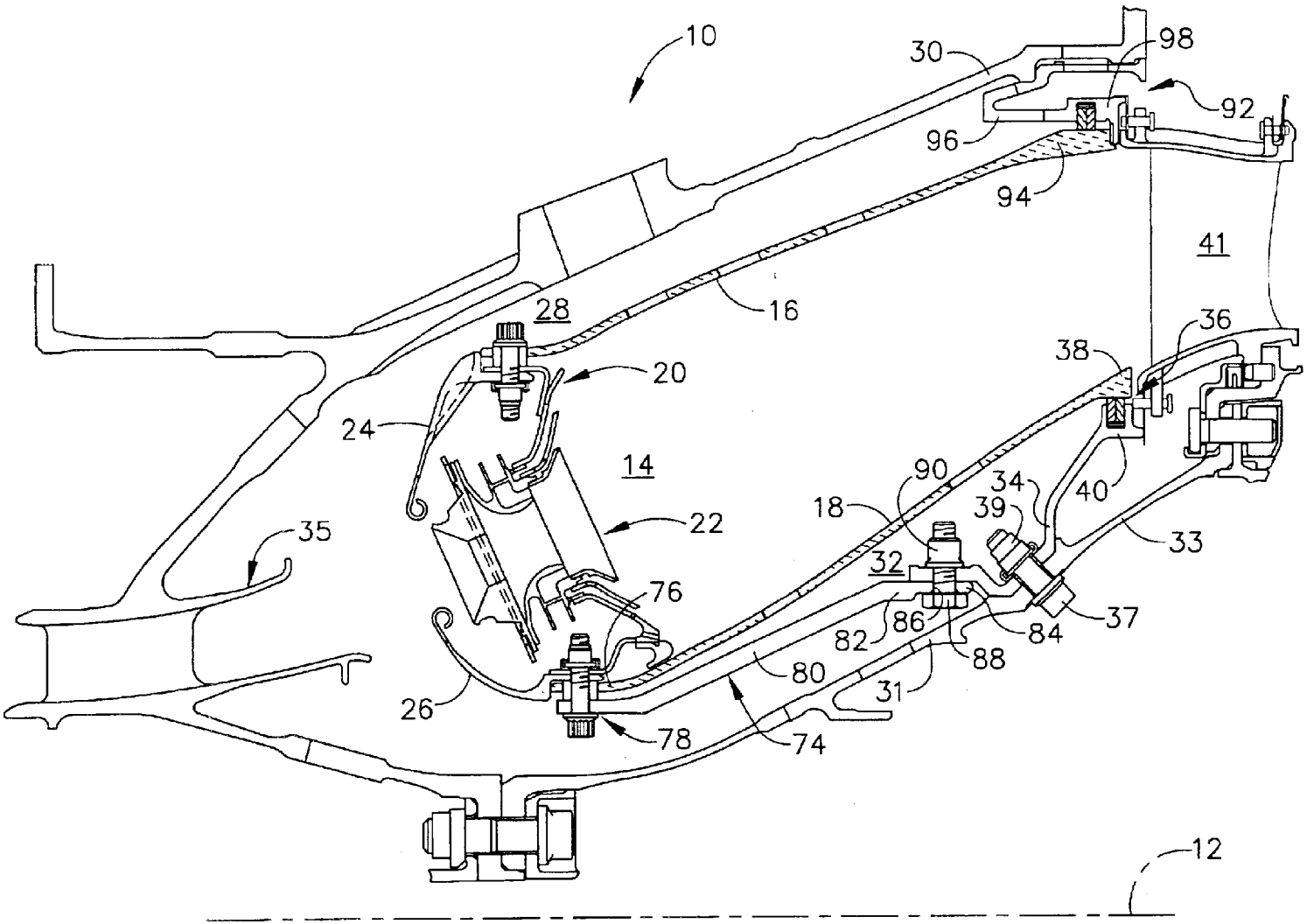
FIG. 1 is a longitudinal cross-sectional view of a gas turbine engine combustor having an inner liner and an outer liner made of ceramic matrix composite and including a sealing assembly for the aft ends thereof in accordance with the present invention.

Referring now to the drawings in detail, wherein identical numerals indicate the same elements throughout the figures, FIG. 1 depicts an exemplary gas turbine engine combustor 10 which conventionally generates combustion gases that are discharged therefrom and channeled to one or more pressure turbines. Such turbine(s) drive one or more pressure compressors upstream of combustor 10 through suitable shaft(s). A longitudinal or axial centerline axis 12 is provided through the gas turbine engine for reference purposes.

It will be seen that combustor 10 further includes a combustion chamber 14 defined by an outer liner 16, an inner liner 18 and a dome 20. Combustor dome 20 is shown as being single annular in design so that a single circumferential row of fuel/air mixers 22 are provided within openings formed in such dome 20, although a multiple annular dome may be utilized. A fuel nozzle (not shown) provides fuel to fuel/air mixers 22 in accordance with desired performance of combustor 10 at various engine operating states. It will also be noted that an outer annular cowl 24 and an inner annular cowl 26 are located upstream of combustion chamber 14 so as to direct air flow into fuel/air mixers 22, as well as an outer passage 28 between outer liner 16 and an outer casing 30 and an inner passage 32 between inner liner 18 and an inner casing 31. In this way, convective cooling air is provided to the outer surfaces of outer and inner liners 16 and 18 and air for film cooling is provided to the inner surfaces of such liners.

An inner annular support member 34, also known herein as an inner support cone, is further shown as being connected to a nozzle support 33 by means of a plurality of bolts 37 and nuts 39. In order to assist in minimizing vibrations experienced by combustor 10, a plurality of circumferentially spaced support members 74 (known as a drag link) are preferably connected to inner support cone34 via a bolt 88 and nut 90. Drag link 74 extends axially forward to be movably connected with a forward end 76 of inner liner 18 via a mounting assembly 78. A diffuser 35 located upstream of combustor 10 receives the air flow from the compressor (s) and provides it to combustor 10. A turbine nozzle 41 is located downstream of combustor 10 and is provided to direct the flow of combustion gases into the turbine(s).

It will be appreciated that outer and inner liners 16 and 18 are preferably made of a ceramic matrix composite (CMC), which is a non-metallic material having high temperature capability and low ductility. Exemplary composite materials utilized for such liners include silicon carbide, silicon, silica or alumina matrix materials and combinations thereof. Typically, ceramic fibers are embedded within the matrix such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials typically have coefficients of thermal expansion in the range of about $1.3\times10^{-6}$ in/in/° F. to about $3.5\times10^{-6}$ in/in/° F. in a temperature range of approximately 1000–1200° F.

By contrast, outer casing 30, nozzle support 33, inner support cone 34 and an outer support member 96 are typically made of a metal, such as a nickel-based superalloy (having a coefficient of thermal expansion of about $8.3–8.6\times10^{-6}$ in/in/° F. in a temperature range of approximately 1000–1200° F). Thus, liners 16 and 18 are better able to handle the extreme temperature environment presented in combustion chamber 14 due to the materials utilized therefor, but providing a seal between inner liner 18 and inner support cone 34 (or between outer liner 16 and outer support member 96), as well as between inner support cone 34 and turbine nozzle 41 (or between outer support member 96 and turbine nozzle 41), presents a separate challenge.

Figure 2:
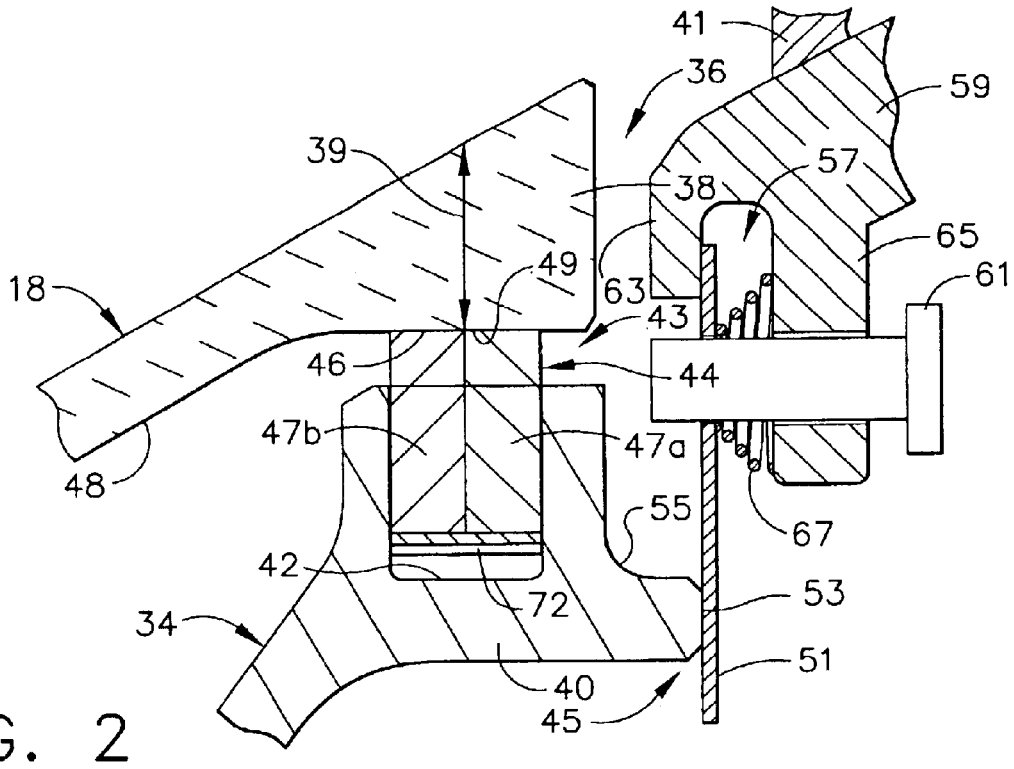
FIG. 2 is an enlarged, partial cross-sectional view of the combustor depicted in FIG. 1, where an embodiment of a sealing assembly for an aft end of the inner liner is shown prior to any thermal growth experienced by the inner liner, the nozzle support, and the inner support cone.
Figure 3:
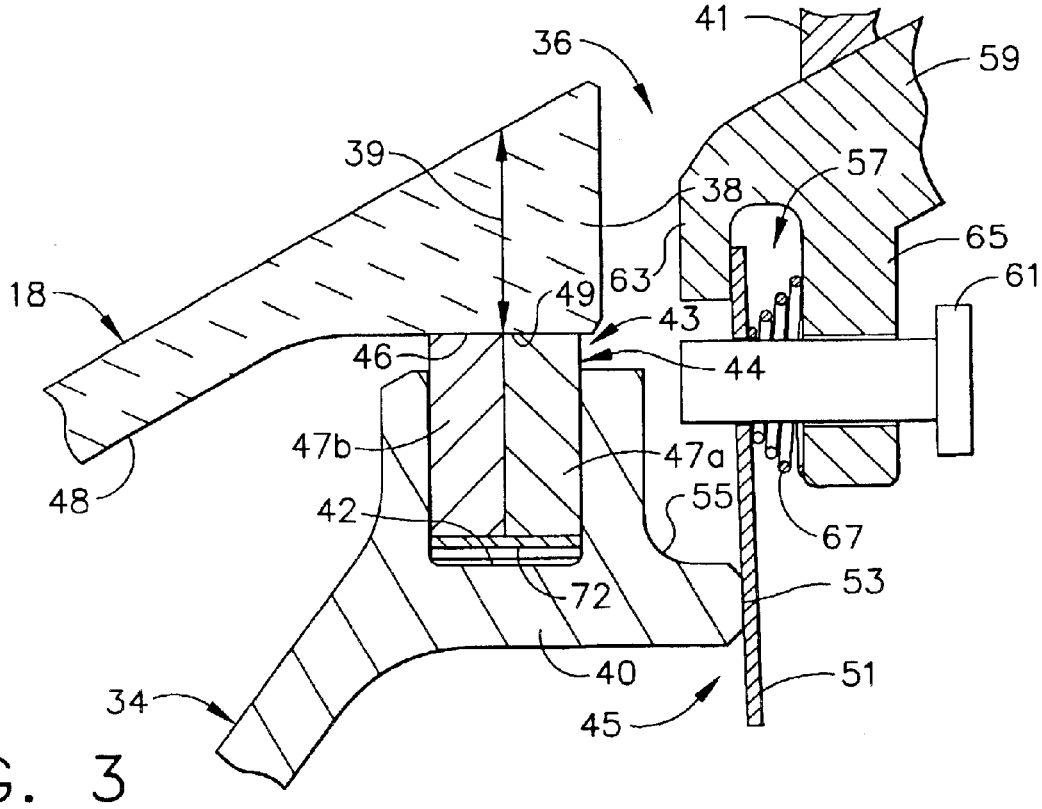
FIG. 3 is an enlarged, partial cross-sectional view of combustor depicted in FIG. 1, where the embodiment of the sealing assembly for an aft end of the inner liner of FIG. 2 is shown after thermal growth is experienced by the inner liner, the nozzle support, and the inner support cone.

Accordingly, it will be seen in FIGS. 2 and 3 that a sealing assembly identified generally by reference numeral 36 is provided between an aft end 38 of inner liner 18 and an aft portion 40 of inner support cone 34, as well as between inner support cone aft portion 40 and turbine nozzle 41, which accommodates varying thermal and mechanical growth experienced by such components. It will be appreciated that sealing assembly 36 shown in FIG. 2 is prior to any thermal growth experienced by inner liner 18, inner support cone 34 and nozzle support 33. As seen in FIG. 3, however, inner liner 18, nozzle support 33, and inner support cone 34 have each experienced thermal growth, with inner support cone 34 and nozzle support 33 having experienced greater thermal growth than inner liner 18 due to their higher coefficients of thermal expansion. Accordingly, inner support cone 34 has been permitted to slide or move in a radial direction with respect to longitudinal centerline axis 12 while maintaining a first seal 43 with inner liner aft end 38 as it expands toward inner liner 18. Inner support cone 34 has also been permitted to slide or move in an axial direction with respect to longitudinal centerline axis 12 while maintaining a second seal 45 with turbine nozzle 41 as it deflects relative to turbine nozzle 41.

More specifically, it will be understood that inner support member aft portion 40 preferably includes an annular channel portion 42 for receiving a substantially annular first sealing member 44 so that first sealing member 44 is positioned between inner support member aft portion 40 and inner liner aft end 38. In particular, first sealing member 44 is preferably made of a flexible or pliant material and is located so as to be seated on a designated portion 46 of a surface 48 of inner liner aft end 38. It will be appreciated that inner liner aft end 38 preferably includes an increased thickness 39 in order to provide designated surface portion 46, which is substantially cylindrical and oriented to be substantially perpendicular to first sealing member 44. By so arranging first sealing member 44, first seal 43 is formed between inner liner aft end 38 and inner support member portion 40 to minimize the amount of air flowing therebetween.

While first seal 43 requires only one annular sealing member to perform the intended function of the present invention, it will be noted from FIGS. 1–5 that a pair of such sealing members 47*a* and 47*b* are preferably utilized in combination to provide the desired seal between inner liner aft end 38 and inner support cone aft portion 40. It will be understood that any number of additional scaling members 66, 68 and 70, either aligned radially with an outer sealing surface 49 of sealing members 47*a* and 47*b* or not, may be utilized (see FIG. 6). Exemplary sealing members and configurations are available from Cross Manufacturing Co., Ltd. of Bath, England. It will also be understood that scaling members 47*a* and 47*b* may either be formed as one piece or by a plurality of annular segments.

Figure 4:
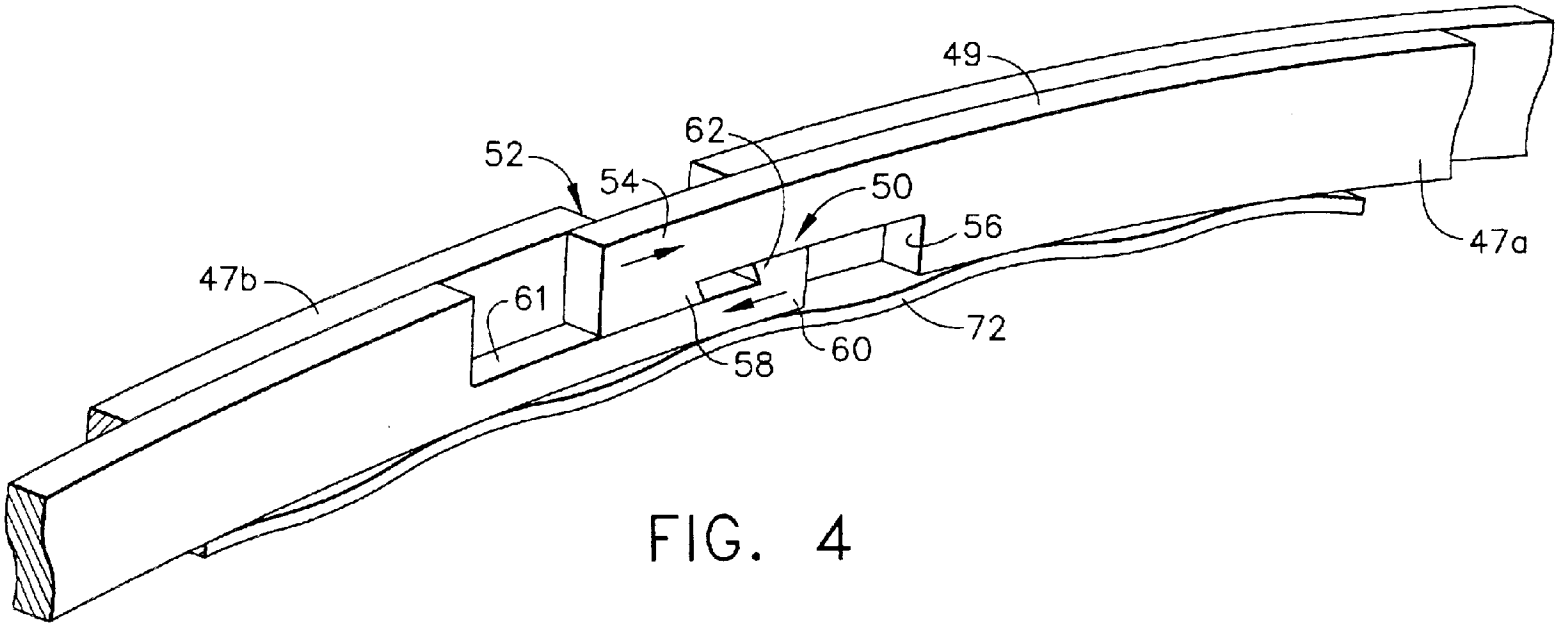
FIG. 4 is an enlarged, partial aft view of a first sealing member depicted in FIGS. 2 and 3, where the first sealing member is in an unlocked position.
Figure 5:
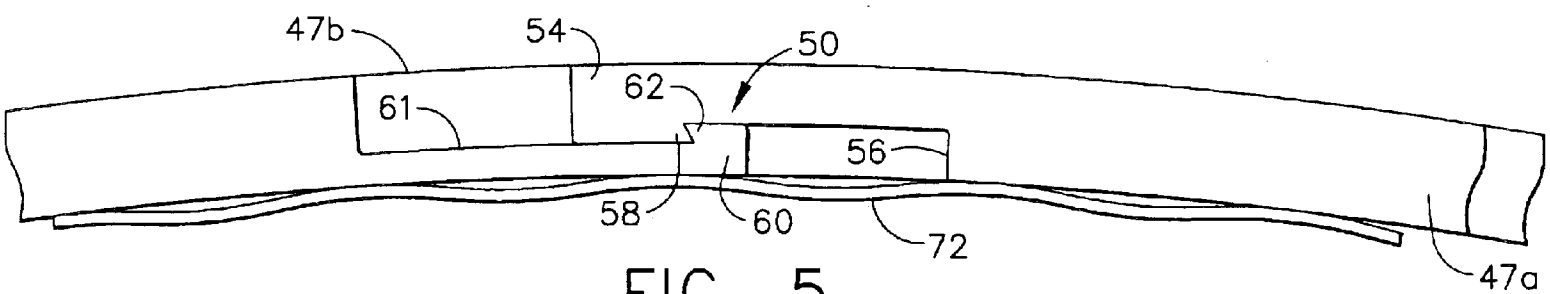
FIG. 5 is an enlarged, partial aft view of the first sealing member depicted in FIGS. 2 and 3, where the first sealing member is in a locked position.
Figure 6:
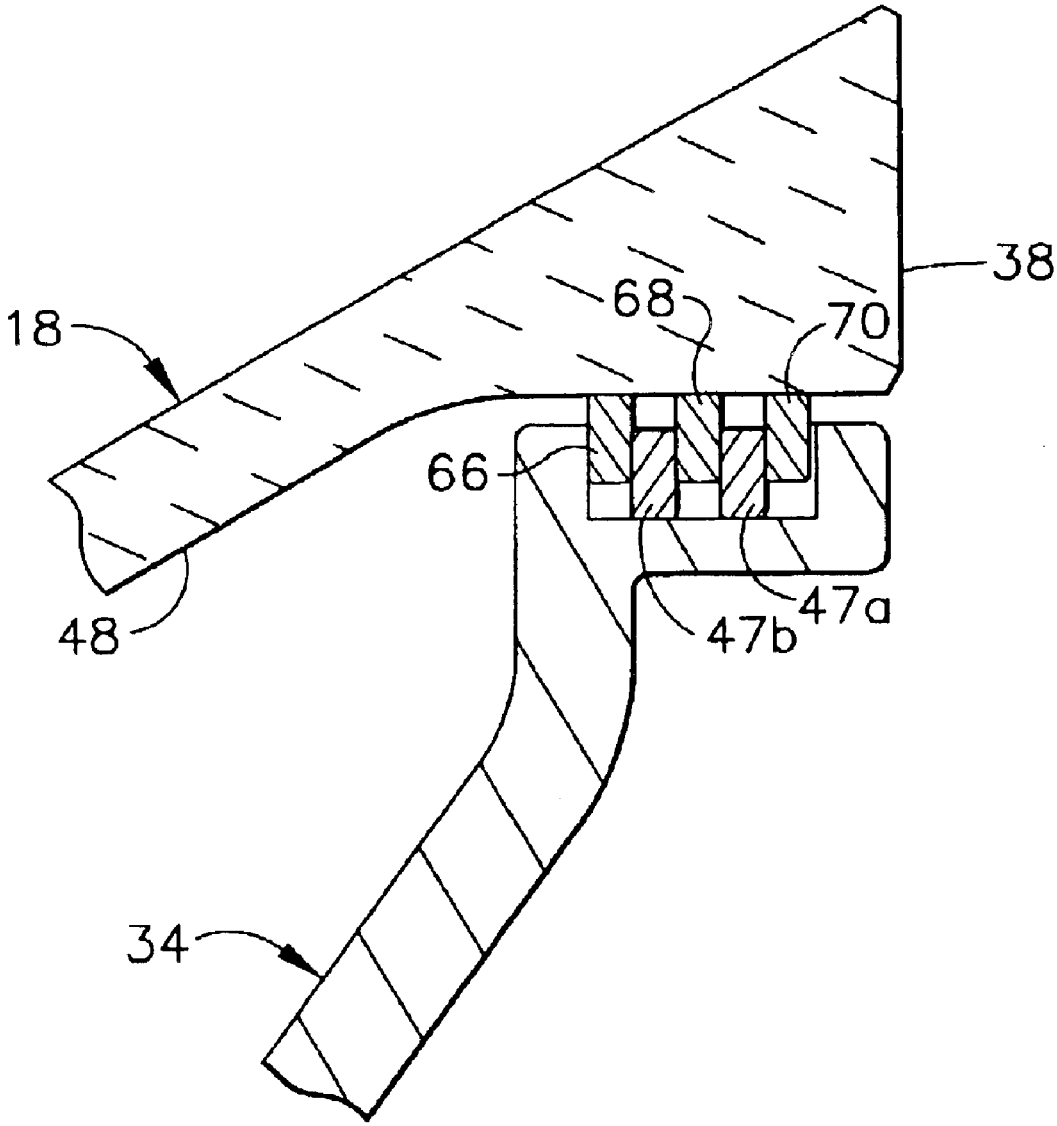
FIG. 6 is an enlarged partial cross-sectional view of the combustor depicted in FIG. 1, where an alternative embodiment of the first sealing member for an aft end of the inner liner is shown.

It will further be noted from FIGS. 4 and 5 that sealing members 47*a* and 47*b* preferably include a locking mechanism 50 and 52, respectively, incorporated therein so that they are retained in an annular configuration. In particular, sealing member 47*a* includes a first end 54 which has a notch portion 56 cut therein with an engaging portion 58. Correspondingly, sealing member 47*b* includes a second end 60 having a complementary notch portion 61 and engaging portion 62 formed therein. It will be appreciated that first and second ends 54 and 60 are then able to be engaged by their respective engaging portions 58 and 62. The length of notch portions 56 and 61 is sized so as to permit case of assembly.

A device 72, preferably in the form of a spring member (such as an annular wavy spring or cockle spring manufactured by Cross Manufacturing Co., Ltd. of Bath, England), is also preferably positioned between inner support member aft portion 40 and sealing members 47*a* and 47*b* so as to maintain sealing members 47*a* and 47*b* in the aforementioned seated position with respect to surface 48 of inner liner aft end 38. It will be appreciated that designated surface portion 46 of inner liner aft end 38 is preferably ground to a smooth finish given the rough surface characteristics of CMC utilized for inner liner 18 so as to improve the durability of first seal 43 and decrease any leakage therebetween. It will be seen from FIGS. 2 and 3 that device 72 is preferably configured so as to be retained Within channel portion 42 of inner support member portion 40.

By arranging sealing members 47*a* and 47*b* and spring member 72 in the foregoing manner, first seal 43 between inner liner 18 and inner support member aft portion 40 is maintained (i.e., sealing member 47*a* and/or sealing member 47*b* is in the seated position) as inner support member aft portion 40 moves radially with respect to inner liner aft end 38. Moreover, sealing member 47*a* and/or sealing member 47*b* is also maintained in the seated position on designated surface portion 46 as inner support member aft portion 40 moves axially with respect to inner liner aft end 38. Such radial and axial movement of inner support cone 34 and portion 40 thereof occurs due to the difference in thermal and mechanical growth experienced by inner support cone 34 and/or nozzle support 33 with respect to that of inner liner 18. It will be seen by a review of FIGS. 2 and 3 that inner support cone aft portion 40 is able to move between a first radial position and a second radial position, as well as between a first axial position and a second axial position, and still permit sealing member 47*a* and/or sealing member 47*b* to maintain the seal with inner liner 18.

Sealing assembly 36 also provides a second seal 45 between inner support cone aft portion 40 and turbine nozzle 41. As seen in FIGS. 2 and 3, an annular leaf seal 51 is located aft of inner support cone aft portion 40 and is configured so as to seat on a designated portion 53 of an aft surface 55 of inner support cone aft portion 40. More specifically, leaf seal 51 is positioned within an annular slot 57 at a forward end of an inner nozzle band 59 for turbine nozzle 41 formed between a first flange 63 and a second flange 65. A plurality of pins 61, which extend through and preferably are attached to second flange 65, are utilized to hold leaf seal 51 in place. Although a pressure differential between combustion chamber 14 and inner passage 32 may assist in holding leaf seal 51 in position, it is preferred that a spring 67 be located around each pin 61 and between second flange 65 and leaf seal 51 to load leaf seal 51 against inner support cone aft portion 40. Accordingly, it will be seen that as inner support cone aft portion 40 moves axially with respect to inner liner aft end 38, it continues to engage leaf seal 51 so as to maintain second seal 45. In addition, leaf seal 51 is configured so as to be maintained in its seated position with designated surface portion 53 when inner support cone aft portion 40 moves in a radial direction with respect to turbine nozzle 41.

Figure 7:
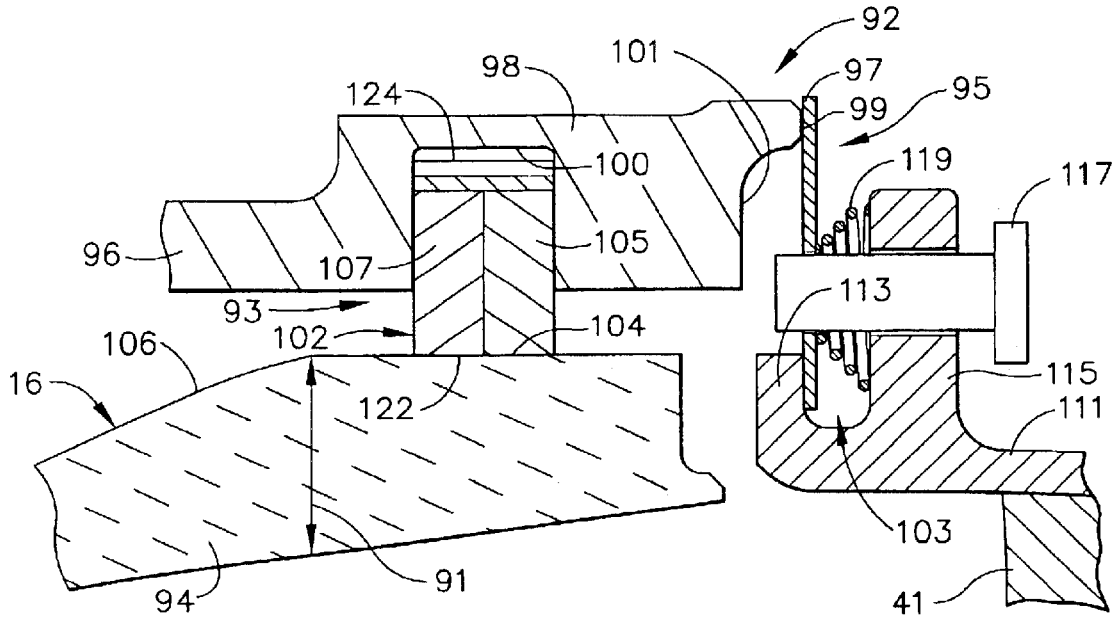
FIG. 7 is an enlarged, partial cross-sectional view of the combustor depicted in FIG. 1, where an embodiment of a sealing assembly for an aft end of the outer liner is shown prior to any thermal growth experienced by the outer liner, the outer casing, and the outer support member.
Figure 8:
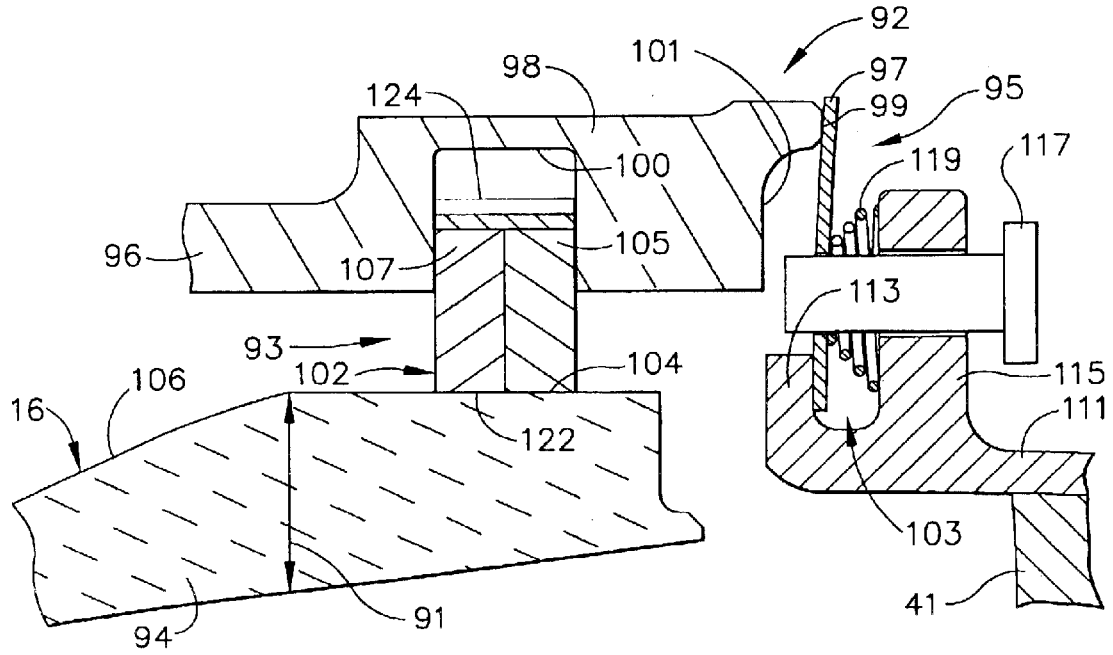
FIG. 8 is an enlarged, partial cross-sectional view of the combustor depicted in FIG. 1, where the embodiment of the sealing assembly for an aft end of the outer liner of FIG. 7 is shown after thermal growth is experienced by the outer liner, the outer casing, and the outer support member.

Similarly, it will be seen in FIG. 7 that a sealing assembly identified generally by reference numeral 92 is provided between an aft end 94 of outer liner 16 and an aft portion 98 of outer support member 96, as well as between outer support member aft portion 98 and turbine nozzle 41, which accommodates varying thermal and mechanical growth experienced by such components. It will be appreciated that sealing assembly 92 shown in FIG. 7 is prior to any thermal growth experienced by outer liner 16, outer casing 30 and outer support member 96. As seen in FIG. 8, however, outer liner 16, outer casing 30 and outer support member 96 have each experienced thermal growth, with outer casing 30 and outer support member 96 having experienced greater thermal growth than outer liner 16 due to their higher coefficients of thermal expansion. Accordingly, outer casing 30 and outer support member 96 are depicted as being permitted to slide or move in a radial direction with respect to longitudinal centerline axis 12 while maintaining a first seal 93 with outer liner aft end 94 as they expand away from outer liner aft end 94. Outer casing 30 and outer support member 96 have also been permitted to slide or move in an axial direction with respect to longitudinal centerline axis 12 while maintaining a second seal 95 with turbine nozzle 41 as they deflect relative to turbine nozzle 41.

More specifically, it will be understood that outer support member aft portion 98 preferably includes an annular channel portion 100 for receiving a substantially annular sealing member 102 so that sealing member 102 is positioned between outer support member aft portion 98 and outer liner aft end 94. In particular, sealing member 102 is preferably made of a flexible or pliant material and is located so as to be seated on a designated portion 104 of a surface 106 of outer liner aft end 94. It will be appreciated that outer liner aft end 94 preferably includes an increased thickness 91 in order to provide designated surface portion 104, which is substantially cylindrical and oriented substantially perpendicular to scaling member 102. By so arranging sealing member 102, first seal 93 is formed between outer liner aft end 94 and outer support member portion 98 to minimize the amount of air flowing therebetween.

While first seal 93 requires only one annular spring member to perform the intended function of the present invention, it will be noted from FIGS. 1 and 7–10 that a pair of such sealing members 105 and 107 are preferably utilized in combination to provide the desired seal between outer liner aft end 94 and outer support member portion 98. It will be understood from above that any number of additional scaling members, either aligned radially with an inner sealing surface 122 of sealing members 105 and 107 or not, may be utilized. It will also be understood that sealing members 105 and 107 may either be formed as one piece or by a plurality of annular segments.

Figure 9:
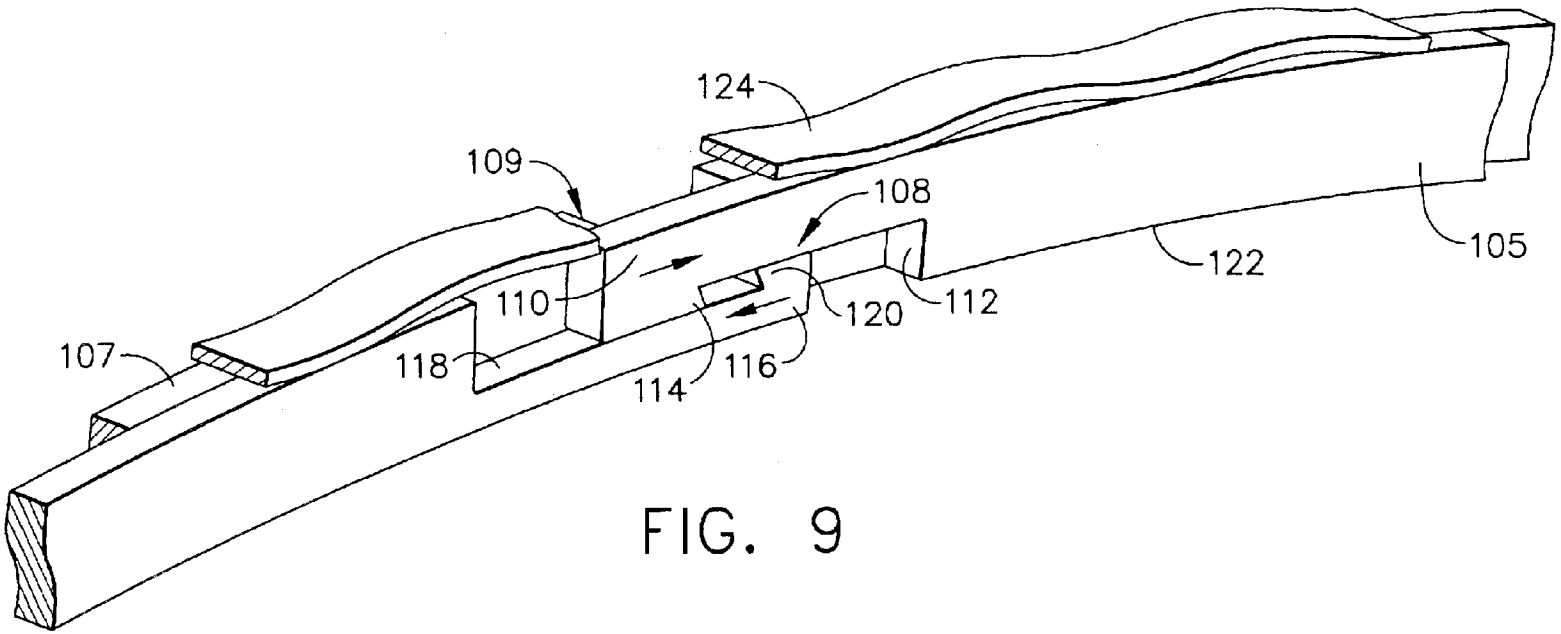
FIG. 9 is an enlarged, partial aft view of a first sealing member depicted in FIGS. 7 and 8, where the first sealing member is in an unlocked position; and, FIG. 10 is an enlarged, partial aft view of the first sealing member depicted in FIGS. 7–9, where the first sealing member is in a locked position.
Figure 10:
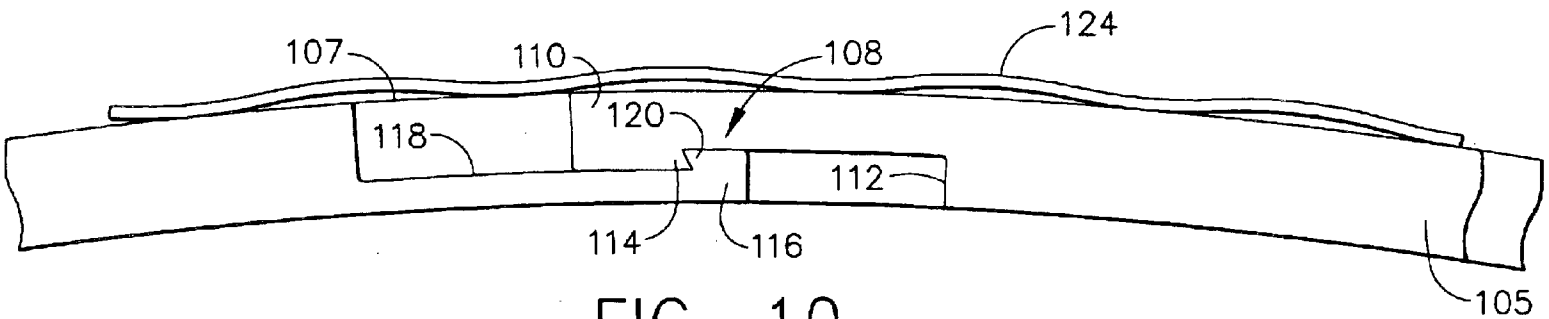

It will further be noted from FIGS. 9 and 10 that sealing members 105 and 107 preferably include a locking mechanism 108 and 109, respectively, incorporated therein like that described hereinabove for locking mechanism 50 so that it is retained in an annular configuration. In particular, sealing member 105 includes a first end 110 which has a notch portion 112 cut therein with an engaging portion 114. Correspondingly, sealing member 105 includes a second end 116 having a complementary notch portion 118 and engaging portion 120 formed therein. It will be appreciated that first and second ends 110 and 116 are then able to be engaged by their respective engaging portions 114 and 120. The length of notch portions 112 and 118 is sized so as to permit ease of assembly.

A device 124, preferably in the form of a spring member (such as an annular wavy spring or cockle spring), is also preferably positioned between outer support member portion 98 and sealing members 105 and 107 so as to maintain sealing members 105 and 107 in the aforementioned seated position with respect to surface 106 of outer liner aft end 94. It will be appreciated that surface portion 104 of outer liner aft end 94 is preferably ground to a smooth finish given the rough surface characteristics of CMC utilized for outer liner 16 so as to improve the durability of first seal 93 and decrease any leakage therebetween. It will also be seen from FIGS. 7 and 8 that device 124 is preferably configured so as to be retained within channel portion 100 of outer support member portion 98.

By arranging sealing members 105 and 107 and spring member 124 in the foregoing manner, first seal 93 between outer liner 16 and outer support member portion 98 is maintained (i.e., sealing member 105 and/or sealing member 107 is in the seated position) as outer support member portion 98 moves radially with respect to outer liner aft end 94. Moreover, sealing member 105 and/or sealing member 107 is also maintained in the seated position on surface portion 104 as outer support member portion 98 moves axially with respect to outer liner aft end 94. Such radial and axial movement of outer support member 96 and portion 98 thereof occurs due to the difference in thermal and mechanical growth experienced by outer support member 96 and/or outer casing 30 with respect to that of outer liner 16. It will be seen by a review of FIGS. 7 and 8 that outer support member portion 98 is able to move between a first radial position and a second radial position, as well as between a first axial position and a second axial position, and still permit sealing member 105 and/or sealing member 107 to maintain the seal with outer liner 16.

Sealing assembly 92 also provides a second seal 95 between outer support member aft portion 98 and turbine nozzle 41. As seen in FIGS. 7 and 8, an annular leaf seal 97 is located aft of outer support member aft portion 98 and is configured so as to seat on a designated portion 99 of an aft surface 101 of outer support member aft portion 98. More specifically, leaf seal 97 is positioned within an annular slot 103 at a forward end of an outer nozzle band 111 for turbine nozzle 41 formed between a first flange 113 and a second flange 115 . A plurality of pins 117, which extend through and preferably are attached to second flange 115, are utilized to hold leaf seal 97 in place. Although a pressure differential between combustion chamber 14 and outer passage 28 may assist in holding leaf seal 97 in position, it is preferred that a spring 119 be located around each pin 117 and between second flange 115 and leaf seal 97 to load leaf seal 97 against outer support member aft portion 98. Accordingly, it will be seen that as outer support member aft portion 98 moves axially with respect to outer liner aft end 94, it continues to engage leaf seal 97 so as to maintain second seal 95. In addition, leaf seal 97 is configured so as to be maintained in its seated position with designated surface portion 99 when outer support member aft portion 98 moves in a radial direction with respect to turbine nozzle 41.

Sealing assembly 36 reflects a method of providing a first seal 43 between inner liner 18 and inner support cone 34 and a second seal 45 between inner support cone 34 and turbine nozzle 41. Similarly, sealing assembly 92 reflects a method of providing a first seal 93 between outer liner 16 and outer support member 96 and a second seal 95 between outer support member 96 and turbine nozzle 41. Since outer and inner liners 16 and 18 are made of a material having a lower coefficient of thermal expansion than outer support member 96 and inner support cone 34, respectively, the method preferably includes a step of maintaining a first sealing member 44 in a seated position between inner liner aft end 38 and inner support member aft portion 40 (or a first sealing member 102 in a seated position between outer liner aft end 94 and outer support member portion 98) in a manner so as to permit radial movement of inner support member 34 with respect to inner liner aft end 38 (or radial movement of outer support member 96 with respect to outer liner aft end 94). The method also preferably includes a step of maintaining a second sealing member (i.e., leaf seal 51) in a seated position between inner support cone aft portion 40 and inner nozzle band 59 (or a second sealing member, i.e., leaf seal 97, in a seated position between outer support member aft portion 98 and outer nozzle band 111) in a manner so as to permit axial movement of inner support member 34 with respect to turbine nozzle 41 (or axial movement of outer support member 96 with respect to turbine nozzle 41).

The method also may include the step of maintaining first sealing member 44 in the seated position between inner liner aft end 38 and inner support cone aft portion 40 (or first sealing member 102 in the seated position between outer liner aft end 94 and outer support member portion 98) so as to permit axial movement of inner support member 34 with respect to inner liner aft end 38 (or permit axial movement of outer support member 96 with respect to outer liner aft end 94). Another method step may include configuring second sealing member 51 (or second sealing member 95) so as to permit radial movement of inner support cone 34 with respect to inner nozzle band 59 (or permit radial movement of outer support member 96 with respect to outer nozzle band 111) and still maintaining second seal 45 (or second seal 95).

Having shown and described the preferred embodiment of the present invention, further adaptations of the sealing assemblies for an aft end of a combustor liner can be accomplished by appropriate modifications by one of ordinary skill in the art without departing from the scope of the invention.

What is claimed is:

1. An assembly providing a seal at an aft end of a combustor liner for a gas turbine engine including a longitudinal centerline axis extending therethrough, said sealing assembly comprising:

(a) a substantially annular first sealing member positioned between an aft portion of a liner-support member and said liner aft end so as to seal on a designated surface portion of said liner aft end; and, (b) a substantially annular second sealing member positioned between said liner-support member aft portion and a turbine nozzle located downstream of said liner aft end so as to seat on a designated surface portion of said liner-support member aft portion, wherein said second sealing member is a leaf seal;

wherein said first sealing member is maintained in its seated position as said liner-support member aft portion moves radially with respect to said liner aft end and said second sealing member is maintained in its seated position as said liner-support member aft portion moves axially with respect to said turbine nozzle, said liner extending the entire length of said combustor.

2. The liner sealing assembly of claim 1, wherein said first sealing member is maintained in its seated position as said liner-support member aft portion moves axially with respect to said liner aft end.

3. The liner sealing assembly of claim 1, wherein said second sealing member is maintained in its seated position as said liner-support member aft portion moves radially with respect to said turbine nozzle.

4. The liner sealing assembly of claim 1, said liner-support member aft portion further comprising an annular channel formed therein for receiving said first sealing member.

5. The liner sealing assembly of claim 4, further comprising a device positioned within said annular channel for encouraging said first sealing member into its seated position with respect to said designated surface portion of said liner aft end.

6. The liner sealing assembly of claim 1, wherein said liner is made of a ceramic matrix composite.

7. The liner sealing assembly of claim 1, wherein said liner-support member is made of a metal.

8. The liner sealing assembly of claim 1, wherein said liner-support member aft portion moves between a first radial position and a second radial position with respect to said liner aft end.

9. The liner sealing assembly of claim 2, wherein said liner-support member aft portion moves between a first axial position and a second axial position with respect to said liner aft end.

10. The liner scaling assembly of claim 1, wherein said lifer-support member aft portion moves between a first axial position and a second axial position with respect to said turbine nozzle.

11. The liner sealing assembly of claim 3, wherein said liner-support member aft portion moves between a first radial position and a second radial position with respect to said turbine nozzle.

12. The liner sealing assembly of claim 1, further comprising a device positioned aft of said liner-support member aft portion for encouraging said second sealing member into its seated position with respect to said designated surface of said liner-support member aft portion.

13. The liner sealing assembly of claim 1, wherein said liner is an inner liner or said combustor.

14. The liner sealing assembly of claim 1, wherein said liner is an outer liner of said combustor.

15. A combustor for a gas turbine engine having a longitudinal centerline axis extending therethrough, comprising:

(a) an inner liner having a forward end and an aft end, said inner liner being made of a ceramic matrix composite material and extending the entire length of said combustor;

(b) an annular inner liner-support member located adjacent to said inner liner aft end, said inner liner-support member being made of a metal; and, (c) an assembly providing a first seal between said inner liner aft end and an aft portion of said inner liner-support member and a second seal between said inner liner-support member aft portion and a turbine nozzle located downstream of said inner liner aft end, wherein said second seal is a leaf seal;

wherein said first seal is maintained between said inner liner-support member aft portion and said inner liner aft end when said inner liner-support member moves with respect to said inner liner aft end in a radial direction and said second seal is maintained between said inner liner-support member aft portion and said turbine nozzle when said inner liner-support member moves with respect to said turbine nozzle in an axial direction.

16. The combustor of claim 15, wherein said first seal is maintained between said inner liner-support member aft portion and said inner liner aft end when said inner liner-support member moves with respect to said inner liner aft end in an axial direction.

17. The combustor of claim 15, wherein said second seal is maintained between said inner liner-support member aft portion and said turbine nozzle when said inner liner-support member moves with respect to said turbine nozzle in a radial direction.

18. A combustor for a gas turbine engine having a longitudinal centerline axis extending therethrough, comprising:

(a) an outer liner having a forward end and an aft end, said outer liner being made of a ceramic matrix composite material and extending the entire length of said combustor, (b) an annular outer liner-support member located adjacent to said outer liner, said outer liner-support member being made of a metal; and, (c) an assembly for providing a first seal between said outer liner aft end and an aft portion of said outer liner-support member and a second seal between said outer liner-support member aft portion and a turbine nozzle located downstream of said outer liner aft end, wherein said second seal is a leaf seal;

wherein said first seal is maintained between said outer liner-support member aft portion and said outer liner aft end when said outer liner-support member moves with respect to said outer liner aft end in a radial direction and said second seal is maintained between said outer liner-support member aft portion and said turbine nozzle when said outer liner-support member moves with respect to said turbine nozzle in an axial direction.

19. The combustor of claim 18, wherein said first seal is maintained between said outer liner-support member aft portion and said outer liner aft end when said outer liner-support member moves with respect to said outer liner aft end in an axial direction.

20. The combustor of claim 18, wherein said second seal is maintained between said outer liner-support member aft portion and said turbine nozzle when said outer liner-support member moves with respect to said turbine nozzle in a radial direction.

21. A method of providing a first seal between an aft end of a liner and an aft portion of an annular liner-support member of a gas turbine engine combustor and a second seal between said liner-support member aft portion and a turbine nozzle located downstream of said liner aft end, wherein said liner is made of a material having a lower coefficient of thermal expansion than said liner-support member and said liner extends the entire length of said combustor, comprising the following steps:

(a) maintaining a first sealing member in a seated position between said liner-support member aft portion and a designated surface portion of said liner aft end so as to permit radial movement of said liner-support member aft portion with respect to said liner aft end; and, (b) maintaining a second sealing member in a seated position between a designated surface portion of said liner-support member aft portion and said turbine nozzle so as to permit axial movement of said liner-support member aft portion with respect to said turbine nozzle, wherein said second sealing member is a leaf seal.

22. The method of claim 21, further comprising the step of maintaining said first sealing member in its seated position between said liner-support member aft portion and said designated surface portion of said liner aft end so as to permit axial movement of said liner-support member aft portion with respect to said liner aft end.

23. The method of claim 21, further comprising the step of configuring said second sealing member so as to maintain its seated position between said designated surface portion of said liner-support member aft portion and said turbine nozzle so as to permit radial movement of said liner-support member aft portion with respect to said turbine nozzle.

* * * * *

UNITED STATES PATENT AND TRADEMARK OFFICE

CERTIFICATE OF CORRECTION

PATENT NO. : 6,895,757 B2
APPLICATION NO. : 10/361456
DATED : May 24, 2005
INVENTOR(S) : Krista Anne Mitchell et al.

It is certified that error appears in the above-identified patent and that said Letters Patent is hereby corrected as shown below:

Col. 10 line 62 delete “scaling” and substitute --sealing--

Col. 11 line 9 delete “or” and substitute --of--

Col. 11 line 56 delete “for”

Signed and Sealed this

Eleventh Day of July, 2006

JON W. DUDAS
*Director of the United States Patent and Trademark Office*